US009689061B2

(12) United States Patent
Angles

(10) Patent No.: US 9,689,061 B2
(45) Date of Patent: Jun. 27, 2017

(54) TOOL STEEL ALLOY WITH HIGH THERMAL CONDUCTIVITY

(71) Applicant: Rovalma S.A., Terrassa (ES)

(72) Inventor: Isaac Valls Angles, Sant Cugat del Valles (ES)

(73) Assignee: Rovalma, S.A., Terrassa (ES)

( * ) Notice: Subject to any disclaimer, the term of this patent is extended or adjusted under 35 U.S.C. 154(b) by 647 days.

(21) Appl. No.: 14/037,538

(22) Filed: Sep. 26, 2013

(65) Prior Publication Data

US 2014/0023551 A1 Jan. 23, 2014

Related U.S. Application Data

(62) Division of application No. 12/376,866, filed as application No. PCT/EP2007/005091 on Jun. 8, 2007, now Pat. No. 8,557,056.

(30) Foreign Application Priority Data

Aug. 9, 2006 (EP) ..... 06118672

(51) Int. Cl.

| | |
|---|---|
| ***C22C 38/12*** | (2006.01) |
| ***C22C 38/22*** | (2006.01) |
| ***C22C 38/44*** | (2006.01) |
| ***C22C 38/58*** | (2006.01) |
| ***C22C 38/24*** | (2006.01) |
| ***C22C 38/02*** | (2006.01) |
| ***C22C 38/04*** | (2006.01) |
| ***C22C 38/30*** | (2006.01) |

(Continued)

(52) U.S. Cl.

CPC ..... *C22C 38/58* (2013.01); *C22C 38/02* (2013.01); *C22C 38/04* (2013.01); *C22C 38/12* (2013.01); *C22C 38/22* (2013.01); *C22C 38/24* (2013.01); *C22C 38/30* (2013.01); *C22C 38/34* (2013.01); *C22C 38/38* (2013.01); *C22C 38/44* (2013.01); *C22C 38/46* (2013.01); *C22C 38/52* (2013.01)

(58) Field of Classification Search

None

See application file for complete search history.

(56) References Cited

FOREIGN PATENT DOCUMENTS

| | | |
|---|---|---|
| CH | 165893 | 2/1934 |
| EP | 1275745 A1 * | 1/2003 |

(Continued)

OTHER PUBLICATIONS

Petition for Inter Partes Review of U.S. Pat. No. 8557056 filed Oct. 24, 2014 IPR 2015-00150.

(Continued)

*Primary Examiner* — Deborah Yee

(74) *Attorney, Agent, or Firm* — Senniger Powers LLP

(57) ABSTRACT

A tool steel, in particular a hot-work steel, has the following composition: 0.26 to 0.55% by weight C; less than 2% by weight Cr; 0 to 10% by weight Mo; 0 to 15% by weight W; wherein the W and Mo contents in total amount to 1.8 to 15% by weight; carbide-forming elements Ti, Zr, Hf, Nb, Ta forming a content of from 0 to 3% by weight individually or in total; 0 to 4% by weight V; 0 to 6% by weight Co; 0 to 1.6% by weight Si; 0 to 2% by weight Mn; 0 to 2.99% by weight Ni; 0 to 1% by weight S; remainder: iron and inevitable impurities. The hot-work steel has a significantly higher thermal conductivity than known tool steels.

26 Claims, 5 Drawing Sheets

(51) Int. Cl.

| | |
|---|---|
| ***C22C 38/34*** | (2006.01) |
| ***C22C 38/38*** | (2006.01) |
| ***C22C 38/46*** | (2006.01) |
| ***C22C 38/52*** | (2006.01) |

(56) References Cited

FOREIGN PATENT DOCUMENTS

| | | | |
|---|---|---|---|
| JP | 53-123860 | * | 7/1983 |
| JP | 1988-282241 | | 11/1988 |
| JP | H04147706 | | 5/1992 |
| JP | H11-222650 | | 8/1999 |

OTHER PUBLICATIONS

Bayati et al., "Influence of matrix structure on physical properties of an alloyed ductile cast iron," Mat. Sci. and Tech., Mar. 1999, vol. 15, p. 265-277.
Patent Owner's Response in IPR of U.S. Pat. No. 8,557,056 (Aug. 14, 2015).
Petitioner's Reply Brief in IPR of U.S. Pat. No. 8,557,056 (Nov. 11, 2015).
Written Decision in IPR of U.S. Pat. No. 8,557,056 (Apr. 20, 2016).

* cited by examiner

TOOL STEEL ALLOY WITH HIGH THERMAL CONDUCTIVITY

RELATED APPLICATION

This Application is a divisional application of application Ser. No. 12/376,866 filed on Feb. 9, 2009 now U.S. Pat. No. 8,557,056.

BACKGROUND OF THE INVENTION

Field of the Invention

The present invention relates to a process for setting the thermal conductivity of a steel, to a tool steel, in particular hot-work steel, and to a use of a tool steel. In addition, the present invention relates to a steel object.

Hot-work steels are alloyed tool steels which, along with iron, contain in particular carbon, chromium, tungsten, silicon, nickel, molybdenum, manganese, vanadium and cobalt in differing fractions as alloying elements.

Hot-work steels can be used for producing hot-work steel objects, such as for example tools, which are suitable for the working of materials, in particular in die casting, in extrusion or in drop forging. Examples of such tools are extrusion dies, forging tools, die-casting dies, punches or the like, which must have special mechanical strength properties at high working temperatures. A further application area for hot-work steels are tools for the injection molding of plastics.

An essential functionality of tool steels, in particular hot-work steels, and steel objects produced from them is that of ensuring during use in technical processes sufficient removal of heat previously introduced or generated in the process itself.

Hot-work tools, which are produced from a hot-work steel, must have not only high mechanical stability at relatively high working temperatures but also good thermal conductivity and good high-temperature wear resistance. Along with adequate hardness and strength, further important properties of hot-work steels are also high hot hardness and good wear resistance at high working temperatures.

A high thermal conductivity of the hot-work steel used to produce tools is of particular significance for some applications, since it can bring about a considerable shortening of the cycle time. Since the operation of hot-forming devices for the hot forming of workpieces is relatively costly, a considerable cost saving can be achieved by a reduction in the cycle times. A high thermal conductivity of the hot-work steel is also of advantage in high-pressure casting, since the casting molds used there have a much longer service life on account of a greatly increased thermal fatigue strength.

The tool steels often used for producing tools typically have a thermal conductivity of the order of approximately 18 to 24 W/mK at room temperature. Generally, the thermal conductivities of the hot-work steels known from the prior art are approximately 16 to 37 W/mK.

For example, EP 0 632 139 A1 discloses a hot-work steel which has a comparatively high thermal conductivity of over 35 W/mK at temperatures up to approximately 1100° C. Along with iron and unavoidable impurities, the hot-work steel known from this document contains:

0.30 to 0.55% by weight C;
less than 0.90% by weight Si;
up to 1.0% by weight Mn;
2.0 to 4.0% by weight Cr;
3.5 to 7% by weight Mo 0.3 to 1.5% by weight of one or more of the elements vanadium, titanium and niobium.

Conventional hot-work tool steels typically have a chromium content of more than 2% by weight. Chromium is a comparatively low-cost carbide former and, in addition, provides the hot-work steel with good oxidation resistance. Furthermore, chromium forms very thin secondary carbides, so that the ratio of the mechanical strength to the toughness in the case of the conventional hot-work tool steels is very good.

German patent DE 10 14 577 B1 discloses a process for producing hot-work tools using a hardening steel alloy. This patent relates in particular to a process for producing operationally hardening hot-work tools, in particular dies for hot press forging, with high crack and fracture strength and with a high yield strength under static compressive loads at high temperature. The hot-forming steels described in this document are also distinguished by a simple, relatively low-cost chemical composition (0.15-0.30% C, 3.25-3.50% Mo, no chromium) and easy heat treatability. The document is primarily concerned with the optimum processes for producing hot press dies including the associated annealing treatments (hardening). Special properties dependent on the chemical composition are not discussed.

CH 481222 relates to a chromium-molybdenum-vanadium-alloyed hot-work steel with good cold hobbing properties for producing tools, such as for example hobs and dies. It is pointed out that the matching of the alloying elements—in particular chromium (1.00 to 3.50% Cr), molybdenum (0.50 to 2.00% Mo) and vanadium (0.10 to 0.30% V)—has a decisive influence on the desired properties, such as for example a low annealing strength (55 kp/mm$^2$), good flow properties, good thermal conductivity and so on.

Japanese document JP 4147706 is concerned with improving the wear resistance of plugs for producing seamless steel pipes by the geometry of the plug and by the chemical composition of the alloy (0.1 to 0.4% C, 0.2 to 2.0% Mn, 0 to 0.95% Cr, 0.5 to 5.0% Mo, 0.5 to 5.0% W). Special measures for increasing the thermal conductivity of the steel are not the subject of this document.

Japanese document JP 2004183008 describes a low-cost ferritic-pearlitic steel alloy of tools (0.25 to 0.45% C, 0.5 to 2.0% Mn, 0 to 0.5% Cr) for the molding of plastics. In this case, the optimum ratio of processability and thermal conductivity is at the forefront.

The steel described in JP 2003253383 comprises a prehardened tool steel for plastics molding with a ferritic-pearlitic basic structure (0.1 to 0.3% C, 0.5 to 2.0% Mn, 0.2 to 2.5% Cr, 0 to 0.15% Mo, 0.01 to 0.25% V), in which the outstanding workability and weldability are at the forefront.

In order to raise the Ac1 transformation temperature in a tool steel which is characterized by a high surface temperature during rolling, and to set excellent processability and low flow stresses, JP 9049067 proposes a specification of the chemical composition (0.05 to 0.55% C, 0.10 to 2.50% Mn, 0 to 3.00% Cr, 0 to 1.50% Mo, 0 to 0.50% V) and in particular increasing the silicon content (0.50 to 2.50% Si).

Document CH 165893 relates to an iron alloy which is suitable in particular for hot-working tools (swages, dies or the like) and has a chemical composition with little chromium (to the extent that it is chromium-free) and containing tungsten, cobalt and nickel (preferably with additions of molybdenum and vanadium). The reduced chromium content or complete absence of chromium as an alloying element is held responsible for significant improvements in properties and the interlinkage of positive alloying properties. It was found that even lowering the chromium fraction by slight amounts produces a much greater influence on the desired properties (for example a good high-temperature fracture strength, toughness and insensitivity to temperature fluctuations, consequently a good thermal conductivity) than the addition of large amounts of W, Co and Ni.

European patent EP 0 787 813 B1 discloses a heat-resistant, ferritic steel with a low Cr and Mn content and with outstanding strength at high temperatures. The purpose of the invention disclosed in the aforementioned document was to provide a heat-resistant, ferritic steel with a low chromium content which has improved creep strength under the conditions of long time periods at high temperatures as well as improved toughness, workability and weldability even in the case of thick products. The description of the alloying influences with respect to carbide formation (coarsening), precipitation and solid-solution strengthening highlights the necessity for stabilizing the structure of the ferritic steel. Lowering the Cr content to below 3.5% is justified by the suppressed reduction in creep strength on account of the coarsening of Cr carbides at temperatures above a temperature of 550° C. as well as an improvement in the toughness, workability and thermal conductivity. However, at least 0.8% Cr is seen as a prerequisite for maintaining the oxidation and corrosion toughness of the steel at high temperatures.

DE 195 08 947 A1 discloses a wear-resistant, temper-resistant and high-temperature resistant alloy. This alloy is aimed in particular at use for hot-work tools in hot primary forming and hot forming technology and is distinguished by very high molybdenum contents (10 to 35%) and tungsten contents (20 to 50%). Furthermore, the invention described in the aforementioned document relates to a simple and low-cost production process, in which the alloy is first created from the melt or by powder-metallurgical means. The content of Mo and W in such large amounts is justified by the increase in temper resistance and high-temperature resistance by solid-solution hardening and by the formation of carbides (or intermetallic phases). Moreover, molybdenum increases the thermal conductivity and reduces the thermal expansion of the alloy. Finally, this document explains the suitability of the alloy for creating surface layers on basic bodies of a different composition (laser-beam, electron-beam, plasma-jet or build-up welding).

German patent DE 43 21 433 C1 relates to a steel for hot-work tools, as used for the primary forming, forming and working of materials (in particular in die casting, extrusion, drop forging or as shear blades) at temperatures of up to 1100° C. It is characteristic that the steel has in the temperature range from 400 to 600° C. a thermal conductivity of over 35 W/mK (although in principle this decreases with increasing alloy content) and at the same time a high wear resistance (tensile strength of over 700 N/mm$^2$). The very good thermal conductivity is attributed on the one hand to the increased molybdenum fraction (3.5 to 7.0% Mo) and on the other hand to a maximum chromium fraction of 4.0%.

JP 61030654 relates to the use of a steel with high resistance to hot cracking and shortness as well as great thermal conductivity as a material for the production of shells for rollers in aluminum continuous casting installations. Here, too, the contrasting tendencies in influencing the resistance to hot cracking or shortness and the thermal conductivity by the alloy composition are discussed. Silicon contents of over 0.3% and chromium contents of over 4.5% are regarded as disadvantageous, especially with respect to the thermal conductivity. Possible procedures for setting a hardened martensitic microstructure of the roller shells produced from the steel alloy according to the invention are presented.

EP 1 300 482 B1 relates to a hot-work steel, in particular for tools for forming at elevated temperatures, with the simultaneous occurrence of the following properties: increased hardness, strength and toughness as well as good thermal conductivity, improved wear resistance at elevated temperatures and extended service life under shock loads. It is described that certain concentrations within narrow limits of carbon (0.451 to 0.598% C) as well as of elements forming alloy carbides and monocarbides (4.21 to 4.98% Cr, 2.81 to 3.29% Mo, 0.41 to 0.69% V) in thermal tempering are conducive to a desired solid-solution hardenability and allow the extensive suppression of carbide hardening or the hardness-increasing precipitation of coarse carbides at the expense of matrix hardness. An improvement in the thermal conductivity by a reduction in the carbide fraction could be based on interface kinetics and/or on the properties of the carbides.

One disadvantage of the tool steels known from the prior art, in particular hot-work steels, and the steel objects produced from them, is that they have only inadequate thermal conductivity for some application areas. Furthermore, it has not so far been possible to set the thermal conductivity of a steel, in particular a hot-work steel, specifically, and consequently in a defined manner, to the respective intended application.

BRIEF SUMMARY OF THE INVENTION

This is where the present invention comes in, and addresses the problem of providing a process by means of which a specific setting of the thermal conductivity of a steel, in particular a hot-work steel, can be achieved. In addition, the present invention is based on the problem of providing a tool steel, in particular a hot-work steel, as well as a steel object, which have a higher thermal conductivity than the tool steels (in particular hot-work steels) or steel objects that are known from the prior art.

This problem is solved with regard to the process by a process with the features of claim 1 and by a process with the features of claim 2. With regard to the tool steel, the problem on which the present invention is based is solved by a tool steel (in particular a hot-work steel) with the features of claim 4, by a tool steel (in particular a hot-work steel) with the features of claim 5 and by a tool steel (in particular a hot-work steel) with the features of claim 6. With regard to the steel object, the problem on which the present invention is based is solved by a steel object with the features of claim 25. The subclaims relate to advantageous developments of the invention.

According to claim 1, a process according to the invention for setting the thermal conductivity of a steel, in particular a hot-work steel, is distinguished in that an internal structure of the steel is metallurgically created in a defined manner such that the carbidic constituents thereof have a defined electron and phonon density and/or the crystal structure thereof has a mean free length of the path for the phonon and electron flow that is determined by specifically created lattice defects. One advantage of the solution according to the invention is that the thermal conductivity of a steel can be specifically set to the desired value by metallurgically creating the internal structure of the steel in a defined manner in the way described above. The process according to the invention is suitable for example for tool steels and hot-work steels.

According to claim 2, a process according to the invention for setting, in particular increasing, the thermal conductivity of a steel, in particular a hot-work steel, is distinguished in that an internal structure of the steel is metallurgically created in a defined manner such that it has in its carbidic constituents an increased electron and phonon density and/or which has as a result of a low defect content in the crystal structure of the carbides and of the metallic matrix surrounding them an increased mean free length of the path for the phonon and electron flow. This measure according to the invention allows the thermal conductivity of a steel to be set in a defined manner, in comparison with the steels known from the prior art, and significantly increased, in particular in comparison with the known hot-work steels.

In a preferred embodiment, the thermal conductivity of the steel at room temperature can be set to more than 42 W/mK, preferably to more than 48 W/mK, in particular to more than 55 W/mK.

According to claim 4, a tool steel according to the invention, in particular a hot-work steel, is distinguished by the following composition:

0.26 to 0.55% by weight C;
<2% by weight Cr;
0 to 10% by weight Mo;
0 to 15% by weight W;
wherein the content of W and Mo in total amounts to 1.8 to 15% by weight;
carbide-forming elements Ti, Zr, Hf, Nb, Ta with a content of from 0 to 3% by weight individually or in total;
0 to 4% by weight y;
0 to 6% by weight Co;
0 to 1.6% by weight Si;
0 to 2% by weight Mn;
0 to 2.99% by weight Ni;
0 to 1% by weight S;
remainder: iron and unavoidable impurities.

Since it has been found that carbon can be at least partially substituted by so-called carbon-equivalent constituents nitrogen (N) and boron (B), a tool steel, in particular a hot-work steel, with the features of claim 5 or with the features of claim 6, that has the chemical compositions presented below, produces an equivalent solution to the problem on which the present invention is based.

According to claim 5, a tool steel according to the invention, in particular a hot-work steel, is distinguished by the following composition:

0.25 to 1.00% by weight C and N in total;
<2% by weight Cr;
0 to 10% by weight Mo;
0 to 15% by weight W;
wherein the content of W and Mo in total amounts to 1.8 to 15% by weight;
carbide-forming elements Ti, Zr, Hf, Nb, Ta with a content of from 0 to 3% by weight individually or in total;
0 to 4% by weight V;
0 to 6% by weight Co;
0 to 1.6% by weight Si;
0 to 2% by weight Mn;
0 to 2.99% by weight Ni;
0 to 1% by weight S;
remainder: iron and unavoidable impurities.

According to claim 6, a further tool steel according to the invention, in particular a hot-work steel, is distinguished by the following composition:

0:25 to 1.00% by weight C, N and B in total;
<2% by weight Cr;
0 to 10% by weight Mo;
0 to 15% by weight W;
wherein the content of W and Mo in total amounts to 1.8 to 15% by weight;
carbide-forming elements Ti, Zr, Hf, Nb, Ta with a content of from 0 to 3% by weight individually or in total;
0 to 4% by weight V;
0 to 6% by weight Co;
0 to 1.6% by weight Si;
0 to 2% by weight Mn;
0 to 2.99% by weight Ni;
0 to 1% by weight S;
remainder: iron and unavoidable impurities.

The particular advantage of the tool steels according to the invention is primarily the drastically increased thermal conductivity in comparison with the tool steels and hot-work steels known from the prior art. It becomes clear that, along with iron as the main constituent, the tool steel according to the invention contains the elements C (or C and N according to claim 5 and C, N and B according to claim 6), Cr, Mo and W in the ranges indicated above as well as unavoidable impurities. The other alloying elements (accompanying alloying elements) are consequently optional constituents of the tool steel, since their content may possibly even be 0% by weight.

A major aspect of the solution described here is that of keeping carbon, and preferably also chromium, out of the steel matrix to a great extent in the solid solution state and substituting the $Fe_3C$ carbides by carbides with higher thermal conductivity. Chromium can only be kept out of the matrix by not being present at all. Carbon can be bound in particular with carbide formers, wherein Mo and W are the lowest-cost elements and, both as elements and as carbides, have a comparatively high thermal conductivity.

Quantum-mechanical simulation models for tool steels, and in particular for hot-work steels, can show that carbon and chromium in the solid solution state lead to a matrix distortion, which results in a shortening of the mean free length of the path of phonons. A greater modulus of elasticity and a higher coefficient of thermal expansion are the consequence. The influence of carbon on the electron and phonon scattering has likewise been investigated with the aid of suitable simulation models. It has consequently been possible to verify the advantages of a matrix depleted of carbon and chromium on the increase in thermal conductivity. While the thermal conductivity of the matrix is dominated by the electron flow, the conductivity of the carbides is determined by the phonons. In the solid solution state, chromium has a very negative effect on the thermal conductivity achieved by electron flow.

The tool steels according to the invention (in particular hot-work steels) according to claims 4, 5 and 6 may have a thermal conductivity at room temperature of more than 42 W/mK, preferably a thermal conductivity of more than 48 W/mK, in particular a thermal conductivity of more than 55 W/mK. It has surprisingly been found that thermal conductivities of the order of more than 50, in particular approximately 55 to 60 W/mK and even above that can be achieved. The thermal conductivity of the hot-work steel according to the invention may consequently be almost twice that of the hot-work steels known from the prior art. Consequently, the steel described here is also suitable in particular for applications in which a high thermal conductivity is required. Consequently, the particular advantage of the tool steel according to the invention over the solutions known from the prior art is the drastically improved thermal conductivity.

In a particularly advantageous embodiment, the thermal conductivity of the tool steel can be set by a process as claimed in one of claims 1 to 3. As a result, the thermal conductivity of the tool steel can be specifically adapted and set application-specifically.

Optionally, the tool steel may contain the carbide-forming elements Ti, Zr, Hf, Nb, Ta in a fraction of up to 3% by weight individually or in total. The elements Ti, Zr, Hf, Nb, Ta are known in metallurgy as strong carbide formers. It has been found that strong carbide formers have positive effects with regard to increasing the thermal conductivity of the tool steel, since they are more capable of removing carbon in the solid solution state from the matrix. Carbides with a high thermal conductivity can additionally further increase the conductivity of the tool steel. It is known from metallurgy that the following elements are carbide formers, given in the following sequence in ascending order of their affinity for carbon: Cr, W, Mo, V, Ti, Nb, Ta, Zr, Hf.

Particularly advantageous in this connection is the generation of relatively large, and consequently elongated carbides, since the overall thermal conductivity of the tool steel follows a mixing law with negative limit effects. The stronger the affinity of an element for carbon, the greater the tendency to form relatively large primary carbides. However, the large carbides act to some extent disadvantageously on some mechanical properties of the tool steel, in particular its toughness, so that a suitable compromise between the desired mechanical and thermal properties has to be found for each intended use of the tool steel.

Optionally, the tool steel may contain the alloying element vanadium with a content of up to 4% by weight. As already explained above, vanadium establishes fine carbide networks. As a result, numerous mechanical properties of the tool steel can be improved for some intended applications. In comparison with molybdenum, vanadium is not only distinguished by its higher affinity for carbon but also has the advantage that its carbides have a higher thermal conductivity. In addition, vanadium is a comparatively low-cost element. One disadvantage of vanadium as compared with molybdenum, however, is that the vanadium remaining in the solid solution state has a comparatively considerably greater negative effect on the thermal conductivity of the tool steel. For this reason, it is not advantageous to alloy the tool steel with vanadium alone.

Optionally, the tool steel may contain one or more solid solution strengthening elements, in particular Co, Ni, Si and/or Mn. So there is optionally the possibility of the tool steel having an Mn content of up to 2% by weight. In order to improve the high-temperature resistance of the tool steel, a Co content of up to 6% by weight may be advantageous, for example, depending on the actual application. In a further preferred embodiment, the tool steel may have a Co content of up to 3% by weight, preferably up to 2% by weight.

In order to increase the toughness of the tool steel at low temperatures, it may optionally be provided that the hot-work steel has a Si content of up to 1.6% by weight.

In order to improve the workability of the tool steel, the tool steel may optionally contain sulfur S with a content of up to 1% by weight.

To make it easier to gain a better basic understanding of the present invention, some of the major aspects of the novel metallurgical design strategy for tool steels with high thermal conductivity (hot-work steels), on which the process according to the invention ds also based, are to be explained below.

For a given cross section through a metallographically prepared specimen of a tool steel, which is schematically represented in FIG. 1, it is possible by means of optical image analysis techniques when examining the microstructure under an optical or scanning electron microscope to record quantitatively the area fractions of the carbides $A_c$ and of the matrix material $A_m$. The large-area carbides are thereby designated primary carbides 1 and the small-area carbides are designated secondary carbides 2. The matrix material represented in the background is identified in FIG. 1 by the designation 3.

Ignoring further constituents of the microstructure (for example inclusions), the area content of the total surface $A_{tot}$ of the tool steel can be determined with good approximation by the following equation:

$$A_{tot}=A_m+A_c$$

By a simple mathematical re-formulation, the following equation is obtained:

$$(A_m/A_{tot})+(A_c/A_{tot})=1$$

The summands of these equations are suitable as weighting factors for a mixing rule theory.

Thus, if it is assumed that the matrix material 3 and the carbides 1, 2 have different properties with regard to their thermal conductivity, the integral total thermal conductivity $\lambda_{int}$ of this system can be described on the basis of such a mixing rule theory as follows:

$$\lambda_{int}=(A_m/A_{tot})*\lambda_m+(A_c/A_{tot})*\lambda_c$$

$\lambda_m$ is in this case the thermal conductivity of the matrix material 3 and $\lambda_c$ is the thermal conductivity of the carbides 1, 2.

This formulation undoubtedly represents a simplified view of the system, which however is entirely suitable for understanding the phenomenological aspects of the invention.

A more realistic mathematical modeling of the integral thermal conductivity of the overall system can be performed, for example, by applying so-called Effective-Medium Theories (EMT). With such a theory, the microstructural composition of the tool steel is described as a composite system comprising spherical individual structural elements, depicting the carbide properties, with isotropic thermal conductivity, which are embedded in the matrix material with other, but likewise isotropic thermal conductivity:

$$\lambda_{int}=\lambda_m+f_c*\lambda_{int}*(3*(\lambda_c-\lambda_m)/(2*\lambda_{int}+A_c)$$

In this equation, $f_c$ describes the volume fraction of the carbides 1, 2.

However, this equation is not uniquely solvable, and therefore can only be used to a limited extent for a specific system design. If the aim is to maximize the system thermal conductivity $\lambda_{int}$ the previously formulated mixing rules can in principle be used to ascertain that such maximization of the system thermal conductivity $\lambda_{int}$ can be achieved if the thermal conductivities of the individual system components $\lambda_c$ and $\lambda_m$ are each successfully maximized.

For the present invention, it is in this case of particular significance that the volume fraction of the carbides $f_c$ ultimately decides which of the two thermal conductivities $\lambda_c$ and $\lambda_m$ is more relevant.

The amount of, carbides is ultimately defined by the application-specific requirements for the mechanical resistance, and in particular for the wear resistance, of the tool steel. So, in particular with regard to the carbide structure, there are most certainly different design specifications for the different main application areas of the tool steels developed according to the invention.

In the area of aluminum die casting, there is only little wear loading caused by contact-induced wear mechanisms, in particular caused by abrasion. The presence of large-area primary carbides as highly wear-resistant constituents of the microstructure is therefore not absolutely necessary. Consequently, the volume fraction of the carbides $f_c$ is mainly determined by the secondary carbides. The amount of $f_c$ is therefore relatively small.

In hot sheet forming, which also comprises the terminological variant press hardening, the tools are subjected to high loading caused by contact-induced wear mechanisms in adhesive and abrasive forms. Therefore, large-area primary carbides are entirely desired, since they can increase the resistance to these wear mechanisms. A consequence of such a microstructure rich in primary carbides is a high amount of $f_c$.

Irrespective of the carbide structure, the ultimate aim is to maximize the thermal conductivity of all system components. However, as a result of the application-specific design specifications for the degree of carbide presence, there is a weighting of the influence of the thermal conductivities of the system components on the integral thermal conductivity of the overall system.

Even this approach differs drastically from the prior art, in which the thermal conductivity is always regarded as an integral physical property of a material. Whenever the prior art is concerned with establishing the influence of individual alloying elements on the thermal conductivity, this tellingly only ever happens by determining integral properties. Consideration of the influence of such alloying elements on the microstructural form, that is to say on the carbide structure and on the matrix, and resultant changes in physical properties for these microstructural system elements has previously been non-existent, and therefore has also never been the basis of a metallurgical design concept for a tool steel in the prior art.

From such integral design aspects, it has been possible to find that reducing the chromium content and increasing the molybdenum content lead to an improvement in the integral thermal conductivity. Tool steels developed on the basis of such a metallurgical design theory usually have a thermal conductivity of 30 W/mK, which, in comparison with a thermal conductivity of 24 W/mK, represents an increase of 25%. Such an increase is already regarded in the prior art as an effective improvement of the property.

It has previously been assumed that a further reduction of the chromium content cannot lead to a further significant improvement in the thermal conductivity. Since a further reduction of the chromium content additionally leads to a lowering of the corrosion resistance of the hot-work steel, corresponding metallurgical formulations have not been investigated and implemented any further with regard to the design of novel tool steels.

For the tool steels according to the invention with a composition according to claim 4, 5 or 6, a completely novel metallurgical concept was used to achieve a drastically improved thermal conductivity, a concept which is capable of setting the thermal conductivity of the microstructural system components in an exactly defined way, and consequently drastically improving the integral thermal conductivity of the tool steel. An important basic idea of the metallurgical concept presented here is that the preferred carbide formers are molybdenum and tungsten and that the heat transfer properties are disadvantageously influenced by even small fractions of chromium dissolved in these carbides, on account of the lengthening of the mean free length of the path of the phonons caused by the defects consequently produced in the crystal structure of the pure carbides.

With this novel metallurgical design theory, integral thermal conductivities of hot-work steels at room temperature of up to 66 W/mK and more can be achieved in an advantageous way. This exceeds the rate of increase of all the concepts known in the prior art by about tenfold. None of the theories that can be found in the prior art provides a comparable reduction of the chromium content for hot-work steels with the objective of improving the thermal conductivity.

For those cases in which a low chromium content similar to the chemical composition described according to the invention is provided, the explicit aim is not to influence the thermal conductivity but to achieve other functional objectives, such as for example in JP 04147706 A to achieve the specific formation of an oxidation layer on the surface of the steel by reducing the oxidation resistance in this region.

It is known in the prior art that, the higher the purity of a material, the higher too its thermal conductivity. Any impurity—that is to say in the case of metallic materials even the addition of any alloying element—inevitably leads to a reduction in the thermal conductivity. For example, pure iron has a thermal conductivity of 80 W/mK, slightly contaminated iron already has a thermal conductivity of less than 70 W/mK. Even the slightest addition of carbon (0.25 percent by volume) and further alloying elements, such as for example manganese (0.08 percent by volume), leads in the case of steel to a thermal conductivity of only just 60 W/mK.

Nevertheless, with the procedure according to the invention, it is surprisingly possible to achieve thermal conductivities of up to 70 W/mK in spite of the addition of further alloying elements, such as for example molybdenum or tungsten. The reason for this unexpected effect is that it is an objective of the invention not to allow, as far as possible, carbon to go into solution in the matrix, but to bound it in the carbides by strong carbide formers and to use carbides with a high thermal conductivity.

If consideration is thus concentrated on the carbides, it is the phonon conductivity that ultimately dominates the thermal conductivity. If it is wished to improve the latter, it is precisely here that design interventions should be made. However, some carbides have a high density of conducting electrons, in particular high-melting carbides with a high metal content, such as for example W6C or Mo3C. In recent investigations, it was found that even very small additions of chromium to just such carbides lead to significant defects of the crystal lattice structure, and consequently to a drastic lengthening of the mean free length of the path for the phonon flow. This results in a reduction in the thermal conductivity. This leads to the clear conclusion that a greatest possible reduction of the chromium content leads to an improvement in the thermal conductivity of the tool steel.

In addition, molybdenum and tungsten should be taken into consideration as preferred carbide formers. Molybdenum is particularly preferred in this connection, since it is a much stronger carbide former than tungsten. The effect of the depletion of molybdenum in the matrix brings about an improved electron conductivity in the matrix, and consequently contributes to a further improvement in the integral thermal conductivity of the overall system.

As already mentioned before, a chromium content that is too low leads at the same time to a lowering of the corrosion resistance of the tool steel. Even if this may be disadvantageous for certain applications, the higher oxidation tendency does not represent any real functional disadvantage for the main applications of the tool steel designed according to the invention, since anticorrosion effects and measures form part of existing operational sequences here in any case.

So, for example, in the case of applications in aluminum die casting, the liquid aluminum itself represents sufficient corrosion protection; in the area of hot sheet forming, it is the outer surface layers of the tools, nitrided to provide protection from wear, that do this. Corrosion-protecting lubricants as well as coolants and release agents likewise play their part in contributing to corrosion protection. In addition, very thin protective layers may be electrodeposited or applied by vacuum coating processes.

The use according to the invention of the tool steels described here (in particular hot-work steels) as a material for producing steel objects, in particular hot-work tools, produces numerous, and in some cases extremely notable, advantages in comparison with the hot-work steels known from the prior art that have previously been used as materials for corresponding hot-work steel objects.

The higher thermal conductivity of the tools produced from the tool steels according to the invention (in particular hot-work steels) allows, for example, a reduction in the cycle times when working/producing workpieces. A further advantage is a significant reduction in the surface temperature of the tool and the reduction of the surface temperature gradient, resulting in a significant effect on the longevity of the tool. This is the case in particular when tool damage is primarily attributable to thermal fatigue, thermal shocks or build-up welding. This is the case in particular with regard to tools for aluminum die-casting applications.

It is likewise surprising that it was possible for the other mechanical and/or thermal properties of the tool steels according to the invention (in particular hot-work steels) either to be improved or at least remain unchanged in comparison with the tool steels known from the prior art. For example, it was possible to reduce the modulus of elasticity, increase the density of the tool steels according to the invention (in particular hot-work steels) in comparison with conventional hot-work steels and lower the coefficient of thermal expansion. In some applications, further improvements can be achieved, such as for example increased mechanical strength at high temperatures or increased wear resistance.

In a preferred embodiment, it is proposed that the tool steel has less than 1.5% by weight Cr, preferably less than 1% by weight Cr. In a particularly preferred embodiment, there is the possibility of the tool steel having less than 0.5% by weight Cr, preferably less than 0.2, in particular less than 0.1% by weight Cr.

As explained above, the presence of chromium in the solid solution state in the matrix of the tool steel has negative effects on its thermal conductivity. The intensity of this negative effect on the thermal conductivity caused by an increase in the chromium content in the tool steel is at the greatest for the interval of less than 0.4% by weight Cr. A graduation in intervals of the decrease in intensity of the disadvantageous effect on the thermal conductivity of the tool steel in the two intervals of more than 0.4% by weight but less than 1% by weight and more than in the 1% by weight but less than 2% by weight is preferred. For applications in which the oxidation resistance of the tool steel (hot-work steel) plays a great role, it is therefore possible, for example, to weigh up the requirements that are expected of the tool steel with regard to the thermal conductivity and the oxidation resistance and are reflected in an optimized chromium fraction as a percentage by weight. Generally, a chromium content of approximately 0.8% by weight provides the tool steel with good corrosion protection. It has been found that additions that go beyond this chromium content of approximately 0.8% by weight may result in an undesired dissolution of chromium in the carbides.

In a preferred embodiment, there is the possibility of the molybdenum content of the tool steel amounting to 0.5 to 7% by weight, in particular 1 to 7% by weight. Of the low-cost carbide formers, molybdenum has a comparatively high affinity for carbon. In addition, molybdenum carbides have a higher thermal conductivity than iron carbides and chromium carbides. Furthermore, the disadvantageous effect of molybdenum in the solid solution state on the thermal conductivity of the tool steel is considerably less in comparison with chromium in the solid solution state. For these reasons, molybdenum is among those carbide formers that are suitable for a large number of applications. For applications which require high toughness, however, other carbide formers with smaller secondary carbides, such as for example vanadium (colonies of approximately 1 to 15 nm in size as opposed to colonies of up to 200 nm in size) are the more advantageous choice.

In numerous applications, molybdenum can be substituted by tungsten. The carbon affinity of tungsten is somewhat less and the thermal conductivity of tungsten carbide is considerably greater.

In a further particularly preferred embodiment, there is the possibility of the content of Mo, W and V in total amounting to 2 to 10% by weight. The content of these three elements in total is in this case dependent in particular on the desired number of carbides, that is to say on the respective application requirements.

The impurities of the tool steel, in particular hot-work steel, may include one or more of the elements Cu, P, Bi, Ca, As, Sn or Pb, with a content of at most 1% by weight individually or in total. Along with Co, Ni, Si and Mn, a further suitable element for solid solution strengthening is, in particular, Cu, so that at least a small fraction of Cu in the alloy may possibly be advantageous. Along with S, which may optionally be present with a content of at most 1% by weight, the elements Ca, Bi or As may also make the workability of the tool steel easier.

The mechanical stability of the tool steel at high temperatures of the alloy-forming carbides is likewise of significance. In this connection, both Mo and W carbides, for example, are more advantageous with regard to the mechanical stability and strength properties than chromium and iron carbides. A depletion of chromium together with the reduction in the carbon content in the matrix leads to an improved thermal conductivity, in particular if this is brought about by tungsten and/or molybdenum carbides.

The processes by which the tool steels presented here (in particular hot-work steels) are produced likewise play an important role for the thermal and mechanical properties thereof. By a specific choice of the production process, the mechanical and/or thermal properties of the tool steel can consequently be specifically varied and, as a result, adapted to the respective intended use.

The tool steels described within the scope of the present invention can be produced, for example, by powder metallurgy (hot-isostatic pressing). There is, for example, also the possibility of producing a tool steel according to the invention by vacuum induction melting or by furnace melting. It has surprisingly been found that the production process that is respectively chosen can influence the resultant carbide size, which for its part can—as already explained above—have effects on the thermal conductivity and the mechanical properties of the tool steel.

The tool steel may, moreover, also be refined by refining processes known per se, such as for example by VAR processes (VAR=Vacuum Arc Remelting), AOD processes (AOD=Argon Oxygen Decarburation) or what are known as ESR processes (ESR=Electro Slag Remelting).

Similarly, a tool steel according to the invention may be produced, for example, by sand casting or precision casting. It may be produced by hot pressing or some other powder-metallurgical process (sintering, cold pressing, isostatic pressing) and, in the case of all these production processes, with or without application of thermomechanical processes' (forging, rolling, power-press extrusion). Even less conventional production methods, such as thixo-casting, plasma or laser application and local sintering, may be used. In order also to produce from the tool steel objects with a composition changing within the volume, the sintering of powder mixtures may be advantageously used.

The steel developed within, the scope of the present invention may also be used as a welding filler (for example in powder form for laser welding, as a rod or profile for metal inert gas welding (MIG welding), metal active gas welding (MAG welding), tungsten inert gas welding (TIG welding) or for welding with covered electrodes).

According to claim 24, a use of a tool steel, in particular a hot-work steel, is proposed as claimed in one of claims 4 to 23, as a material for producing a hot-work steel object, in particular a hot-work tool, which has a thermal conductivity at room temperature of more than 42 W/mK, preferably a thermal conductivity of more than 48 W/mK, in particular a thermal conductivity of more than 55 W/mK.

A steel object according to the invention is distinguished by the features of claim 25 and consists at least partially of a tool steel, in particular of a hot-work steel, as claimed in one of claims 4 to 23.

In an advantageous embodiment, there is the possibility of the steel object having a thermal conductivity that is substantially constant over its entire volume. In particular, in this embodiment, the steel object may consist completely of a tool steel, in particular of a hot-work steel, as claimed in one of claims 4 to 23.

In a particularly preferred embodiment, it may be provided that the steel object has, at least in portions thereof, a changing thermal conductivity.

According to a particularly advantageous embodiment, at room temperature the steel object may have, at least in portions thereof, a thermal conductivity of more than 42 W/mK, preferably a thermal conductivity of more than 48 W/mK, in particular a thermal conductivity of more than 55 W/mK. At room temperature, the steel object may also have over its entire volume a thermal conductivity of more than 42 W/mK, preferably a thermal conductivity of more than 48 W/mK, in particular a thermal conductivity of more than 55 W/mK.

In advantageous embodiments, the steel object may, for example, be a shaping tool in processes involved in the pressure forming, shear forming, or bending forming of metals, preferably in free forging processes, thixo-forging processes, extrusion or power-press extrusion processes, die-bending processes, contour roll forming processes or in flat, profile and cast-rolling processes.

In further advantageous embodiments, the steel object may be a shaping tool in processes involved in the tension-pressure forming and tension forming of metals, preferably in press-hardening processes, deep-drawing processes, stretch-drawing processes and collar-forming processes.

In further preferred embodiments, the steel object may, for example, be a shaping tool in processes involved in the primary forming of metallic starting materials, preferably in die-casting processes, pressure die-casting processes, thixo-casting processes, cast-rolling processes, sintering processes and hot-isostatic pressing processes.

Furthermore, there is the possibility of the steel object being a shaping material in processes involved in the primary forming of polymeric starting materials, preferably in injection-molding processes, extrusion processes and extrusion blow-molding processes, or a shaping tool in processes involved in the primary forming of ceramic starting materials, preferably in sintering processes.

In a further preferred embodiment, the steel object may be a component for machines and installations for energy generation and energy conversion, preferably for internal combustion engines, reactors, heat exchangers and generators.

Furthermore, there is the possibility of the steel object being a component for machines and installations for chemical process engineering, preferably for chemical reactors.

Further features and advantages of the present invention become clear from the following description of preferred examples with reference to the accompanying figures, in which:

DESCRIPTION OF THE INVENTION

Figure 1:
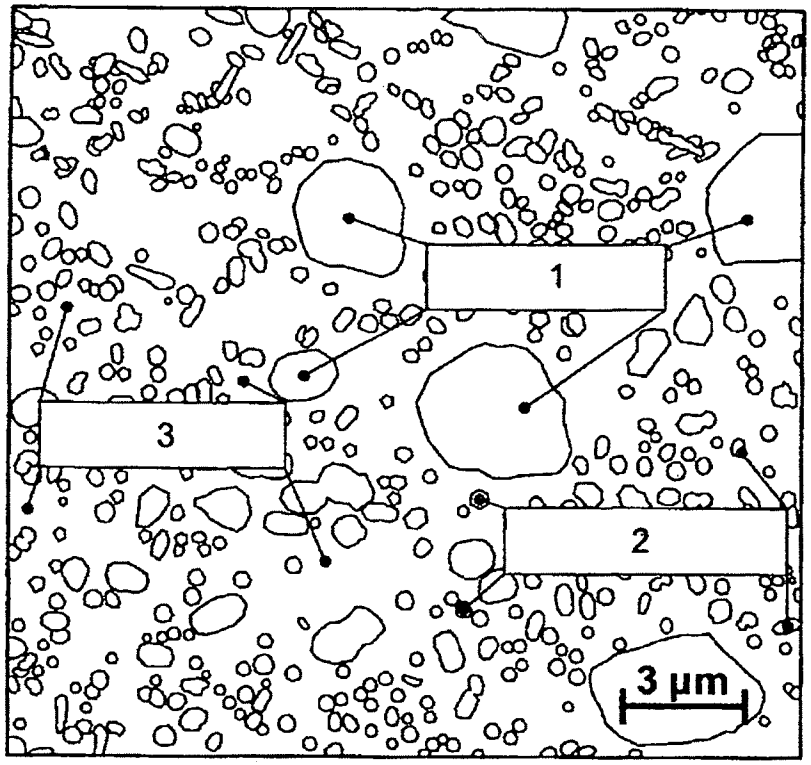
FIG. 1 shows a schematically greatly simplified contour representation of a carbide structure in microstructural cross section of a typical tool steel.

To begin, five examples of tool steels (hot-work steels) that are suitable for different intended uses are to be explained in more detail.

Example 1

It has been found that the use of a hot-work steel with the following composition is particularly advantageous for the production of tools (hot-work steel objects) that are used for the hot forming (hot stamping) of steel sheets:

0.32 to 0.5% by weight C;
less than 1% by weight Cr;
0 to 4% by weight V;
0 to 10% by weight, in particular 3 to 7% by weight, Mo;
0 to 15% by weight, in particular 2 to 8% by weight, W;
wherein the content of Mo and W in total amounts to 5 to 15% by weight.

In addition, the hot-work steel contains unavoidable impurities and iron as the main constituent. Optionally, the hot-work steel may contain strong carbide formers, such as for example Ti, Zr, Hf, Nb, Ta, with a content of up to 3% by weight individually or in total. In the case of this application, the abrasion resistance of the tool produced from the hot-work steel plays a particularly important role. The volume of the primary carbides formed should therefore be as great as possible Example 2

Aluminum die casting is currently a very important market, in which the properties of the hot-work steels used to produce the tools play an important role in determining competitiveness. The mechanical properties at high temperatures of the hot-work steel used to produce a die-casting tool are of particular significance here. In such a case, the advantage of increased thermal conductivity is particularly important, since not only is a reduction in the cycle time made possible, but also the surface temperature of the tool and the temperature gradient in the tool are reduced. The positive effects on the durability of the tools are considerable in this case. In die-casting applications, in particular with regard to aluminum die casting, the use of a hot-work steel with the following composition as a material for producing a corresponding tool is particularly advantageous:

0.3 to 0.42% by weight C;

less than 2% by weight, in particular less than 1% by weight, Cr;

0 to 6% by weight, in particular 2.5 to 4.5% by weight, Mo;

0 to 6% by weight, in particular 1 to 2.5% by weight, W;

wherein the content of Mo and W in total amounts to 3.2 to 5.5% by weight;

0 to 1.5% by weight, in particular 0 to 1% by weight, V.

In addition, the hot-work steel contains iron (as the main constituent) and unavoidable impurities. Optionally, the hot-work steel may contain strong carbide formers, such as for example Ti, Zr, Hf, Nb, Ta, with a content of up to 3% by weight individually or in total.

In aluminum die-casting applications, $Fe_3C$ should not be present as far as possible. Cr and V with additions of Mo and W are in this case the preferred elements as substitutes for $Fe_3C$. Preferably, however, Cr is likewise substituted by Mo and/or W. W and/or Mo may likewise be used in some applications to substitute vanadium, preferably completely but at least partially. Alternatively, however, stronger carbide formers, such as for example Ti, Zr, Hf, Nb or Ta, may also be used. The choice of carbide formers and the fractions thereof depend once again on the actual application and on the requirements with regard to the thermal and/or mechanical properties of the tool that is produced from the hot-work steel.

Example 3

In the die casting of alloys with a comparatively high melting point, the use of a hot-work steel with the following composition for producing a corresponding tool is advantageous:

0.25 to 0.4% by weight C;

less than 2% by weight, in particular less than 1% by weight, Cr;

0 to 5% by weight, in particular 2.5 to 4.5% by weight, Mo;

0 to 5% by weight, in particular 0 to 3% by weight, W;

wherein the content of Mo and W in total amounts to 3 to 5.2% by weight;

0 to 1% by weight, in particular 0 to 0.6% by weight, V.

In addition, the hot-work steel contains unavoidable impurities as well as iron as the main component. Optionally, the hot-work steel may contain strong carbide formers, such as for example Ti, Zr, Hf, Nb, Ta, with a content of up to 3% by weight individually or in total. A greater toughness of the hot-work steel is required in this application, so that primary carbides should be suppressed as completely as possible; consequently, stable carbide formers are more advantageous.

Example 4

In the injection molding of plastics and in the die casting of alloys with a relatively low melting point, the use of a hot-work steel with the following composition for producing a corresponding tool is particularly advantageous:

0.4 to 0.55% by weight C;

less than 2% by weight, in particular less than 1% by weight, Cr;

0 to 4% by weight, in particular 0.5 to 2% by weight, Mo;

0 to 4% by weight, in particular 0 to 1.5% by weight, W;

wherein the content of Mo and W in total amounts to 2 to 4% by weight;

0 to 1.5% by weight V.

In addition, the hot-work steel contains iron as the main constituent as well as unavoidable impurities. Optionally, the hot-work steel may contain strong carbide formers, such as Ti, Zr, Hf, Nb, Ta, with a content of up to 3% by weight individually or in total. In these application areas, the vanadium fraction should be kept as low as possible. Preferably, the vanadium content of the hot-work steel may amount to less than 1% by weight, and in particular less than 0.5% by weight, and in a particularly preferred embodiment less than 0.25% by weight.

The requirements with regard to the mechanical properties of the tools are relatively low in the case of injection molding. A mechanical strength of approximately 1500 MPa is generally sufficient. However, a higher thermal conductivity makes it possible to shorten the cycle times when producing injection-molded parts, so that the costs for producing the injection-molded parts can be reduced.

Example 5

In hot forging, it is particularly advantageous to use a hot-work steel which has the following composition for producing a corresponding tool:

0.4% to 0.55% by weight C;

less than 1% by weight Cr;

0 to 10% by weight, in particular 3 to 5% by weight, Mo;

0 to 7% by weight, in particular 2 to 4% by weight, W;

wherein the content of Mo and W in total amounts to 6 to 10% by weight;

0 to 3% by weight, in particular 0.7 to 1.5% by weight, V.

In addition, the hot-work steel contains iron as the main constituent and unavoidable impurities. Optionally, the hot-work steel may contain strong carbide formers, such as for example Ti, Zr, Hf, Nb, Ta, with a fraction of up to 3% by weight individually or in total.

In this example, the hot-work steel may advantageously contain elements for solid solution strengthening, in particular Co, but also Ni, Si, Cu and Mn. In particular, a Co content of up to 6% by weight has proven to be advantageous for improving the high-temperature resistance of the tool.

With the aid of the hot-work steels described here by way of example, which are suitable for a large number of different applications, it is possible to obtain a thermal, conductivity that is approximately twice that of the known hot-work steels.

In Table 1, some thermoplastic characteristics of five exemplary specimens (specimen F1 to specimen F5) of a hot-work steel according to the present invention are shown in comparison with conventional tool steels. It can be seen, for example, that the hot-work steels have a higher density than the known tool steels. Furthermore, the results show that the thermal conductivity of the specimens of the hot-work steel according to the invention is drastically increased in comparison with the conventional tool steels.

In Table 2, the mechanical properties of two hot-work steel specimens (specimens F1 and F5) according to the present invention are compiled in comparison with conventional tool steels.

Figure 2:
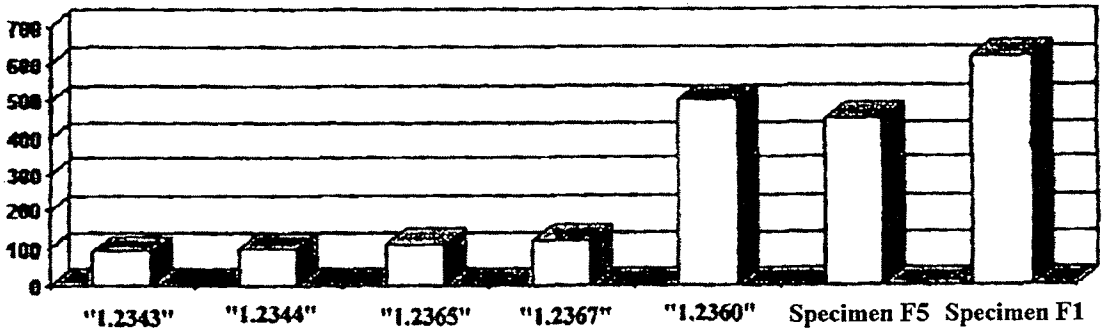
FIG. 2 shows the abrasion resistance of two specimens (F1 and F5) of a hot-work steel according to the present invention in comparison with conventional tool steels.

In FIG. 2, the abrasion resistance of two specimens (F1 and F5) of a hot-work steel is shown in comparison with conventional tool steels. The abrasion resistance was in this case determined with the aid of a pin produced from the corresponding steel and a plate of an USIBOR-1500P sheet. The specimen "1.2344" is in this case the reference specimen (abrasion resistance: 100%). A material with an abrasion resistance of 200% consequently has an abrasion resistance twice that of the reference specimen, and consequently undergoes only half the weight loss during the implementation of the abrasion test procedure. It can be seen that the specimens of the hot-work steel according to the invention have a very high abrasion resistance in comparison with most known steels.

Further preferred examples of tool steels, in particular hot-work steels, according to the present invention and their properties are discussed in more detail below.

The heat and temperature conductivity are the most important thermophysical material parameters for describing the heat transfer properties of a material or component. For exact measurement of the temperature conductivity, what is known as the Laser Flash Technique (LFA) has become established as a quick, versatile and accurate absolute method. The corresponding test specifications are set out in the relevant standards DIN 30905 and DIN EN 821. The LFA 457 MicroFlash® from the company NETZSCH-Gerätebau GmbH, VVittelsbacherstrasse 42, 95100 Selb/Bavaria (Germany) was used for the present measurements.

The thermal conductivity λ can then be determined very easily from the measured temperature conductivities a and the specific heat $c_p$ as well as the density ρ determined for the specific specimen on the basis of the calculation equation $$\lambda=\rho\cdot c_p\cdot a.$$

Figure 3:
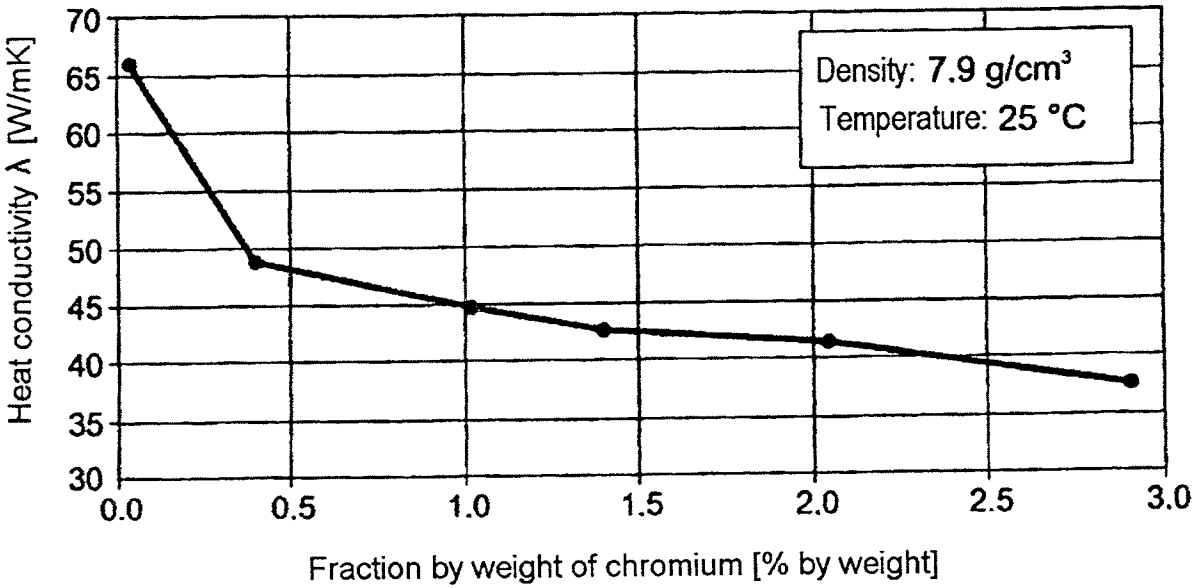
FIG. 3 shows the dependence of the thermal conductivity of the chromium content of tool steels according to the invention (hot-work steels), suitable for use in hot forming processes.

In FIG. 3, the dependence, determined by this method, of the thermal conductivity on the fraction by weight of chromium is shown for a selection of tool steels of the chemical composition respectively identified in Table 3 by FC and FC+xCr. In this case, the composition differs in particular in the fraction by weight of the alloying element chromium as a percentage.

In addition to the setting of desired thermal conductivities possible according to the present invention, these steels have a high resistance to abrasive and adhesive wear as a result of a comparatively great fraction by volume of primary carbides, and are consequently suitable for high mechanical loads, as typically occur in hot forming processes.

Figure 4:
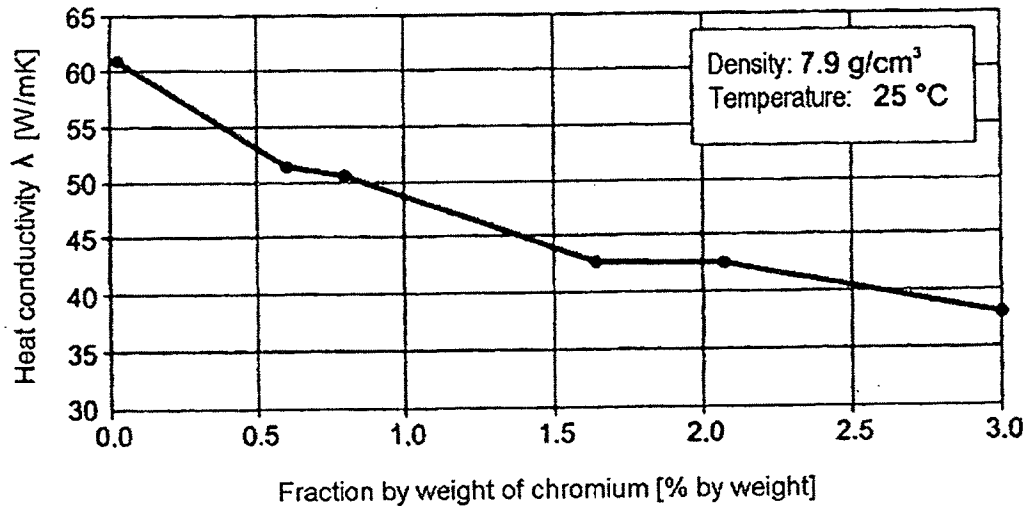
FIG. 4 shows the dependence of the thermal conductivity on the chromium content for a further selection of tool steels according to the present invention.

In FIG. 4, the dependence, determined by the method described above, of the thermal conductivity on the fraction by weight of chromium is shown for a selection of tool steels of the chemical composition respectively identified in Table 4 by FM and FM+xCr. In this case, the compositions differ in particular in the fraction by weight of the alloying element chromium as a percentage. These tool steels are suitable in particular for use in die-casting processes, since they are characterized by a comparatively small fraction of primary carbides.

In Table 5, the chemical composition of a tool steel F according to the invention is summarized for comparative investigation of the process behavior.

Figure 5:
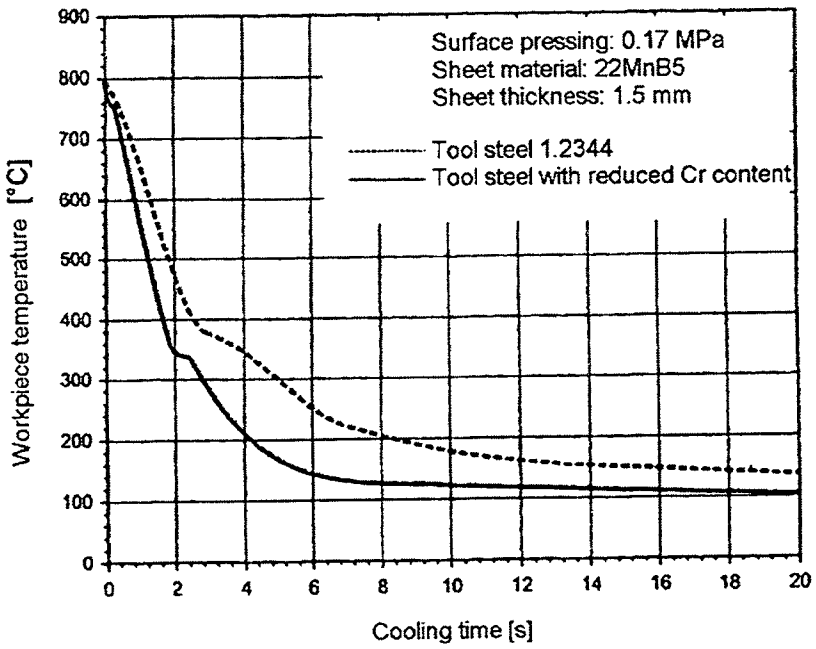
FIG. 5 shows a representation of the heat removal achieved in a preheated workpiece by way of heat conduction in two-sided contact with two tool-steel plates.

Under near-process conditions, as occur inter alia also in hot sheet forming, it was possible by means of a pyrometric temperature measurement to demonstrate with a tool steel which has the chemical composition identified in Table 5 by F an accelerated removal of the heat stored in the workpiece as a result of preheating in comparison with a conventional tool steel with the designation 1.2344 according to DIN 17350 EN ISO 4957. The results of the pyrometric temperature measurements are compiled in FIG. 5.

Taking into consideration the tool temperature customary in these processes of approximately 200° C., a shortening of the cooling time of approximately 50% can be achieved with the tool steel according to the invention that is used here.

Along with the inventive aspects of the basic setting of the thermal conductivity obtained by a suitable choice of the chemical composition, the present invention also comprises the aspect of fine setting obtained by a defined heat treatment.

In Table 6, the influence of different heat treatment conditions for the alloy variants F, with the chemical composition summarized in Table 5, and FC, with the chemical composition summarized in Table 3, on the resultant thermal conductivity is shown by way of example.

The reason for the differently established thermal conductivity, depending on the heat treatment, is the consequently changing fraction by volume of carbides and their changed distribution and morphology.

It has already been pointed out before that, with a view to increasing the thermal conductivity, the fraction by weight of carbon, including the carbon-equivalent constituents N and B (carbon equivalent $xCeq=xC+0.86\cdot xN+1.2\cdot xB$, wherein xC is the fraction by weight of C as a percentage, xN is the fraction by weight of N as a percentage and xB is the fraction by weight of B as a percentage), is intended to be set in the chemical composition of the alloy according to the invention such that as little carbon as possible remains in solution in the matrix. The same applies to the fraction by weight of molybdenum xMo (% Mo) and tungsten xW (% W); as far as possible, these, too, are not to remain in dissolved form in the matrix, but rather are to contribute to carbide forming. This also applies in a similar form to all further elements; these, too, are intended to contribute to carbide forming and therefore not remain dissolved in the matrix, but rather serve for bounding carbon, and possibly increasing the wear resistance and the mechanical loading.

The statements made above can be transferred—albeit with some restrictions—into a general descriptive theory in the form of an equation for a characteristic HC of the tool steel:

$$HC=xCeq-AC\cdot[xMo/(3\cdot AMo)+xW/(3\cdot AW)+(xV-0.4)/AV].$$

In this equation:

xCeq is the fraction by weight of carbon equivalent as a percentage (as defined above);

xMo is the fraction by weight of molybdenum as a percentage;
xW is the fraction by weight of tungsten as a percentage;
xV is the fraction by weight of vanadium as a percentage;
AC is the atomic mass of carbon (12.0107 u);
AMo is the atomic mass of molybdenum (95.94 u);
AW is the atomic mass of tungsten (183.84 u);
AV is the atomic mass of vanadium (50.9415 u).

The HC value should advantageously lie between 0.03 and 0.165. The HC value may also lie between 0.05 and 0.158, in particular between 0.09 and 0.15.

The factor 3 appears in the statement presented above for the case where carbides of the type M3C or M3Fe3C are expected in the microstructure of the tool steel according to the invention; M stands here for any desired metallic element. The factor 0.4 appears on account of the fact that the desired fraction by weight of vanadium (V) as a percentage is usually added during the production of the alloy as a chemical compound in the form of carbides and is consequently likewise present up to this fraction as metal carbide MC.

Further Application Areas of the Tool Steels (Hot-Work Steels) According to the Present Invention With respect to the further use of preferred exemplary embodiments of tool steels according to the invention (in particular hot-work steels), application areas that are conceivable in principle are ones in which a high thermal conductivity or a profile of varying thermal conductivities set in a defined manner has a positive effect on the application behavior of the tool used and on the properties of the products produced with it.

With the present invention, a steel with an exactly defined thermal conductivity can be obtained. There is even the possibility, by changing the chemical composition, of obtaining a steel object which consists at least partially of one of the tool steels presented here (hot-work steels) with a thermal conductivity changing over the volume. In this case, any process that makes it possible to change the chemical composition within the steel object can be used, such as for example the sintering of powder mixtures, local sintering or local melting or what are known as rapid tooling processes or rapid prototyping processes, or a combination of rapid tooling processes and rapid prototyping processes.

Along with the applications already mentioned in the area of hot sheet forming (press hardening) and lightweight metal die casting, preferred application areas for the hot-work steels according to the invention are generally tool- and mold-dependent metal casting processes, plastics injection molding and processes involved in solid-stock forming, particular hot solid-stock forming (for example forging, extrusion or power-press extrusion, rolling).

On the product side, the steels presented here are ideally suited for being used to produce cylinder linings in internal combustion engines, for machine tools or brake disks.

In Table 7, further exemplary embodiments of tool steels according to the invention (hot-work steels) other than the alloy variants already presented in Tables 3 and 4 are presented.

Preferred applications of the alloy variants compiled in Table 7 are:

FA: aluminum die casting;
FZ: forming of copper and copper alloys (including brass);
FW: die casting of copper and copper alloys (including brass) as well as of higher-melting metal alloys;
FV: forming of copper and copper alloys (including brass);
FAW: die casting of copper and copper alloys (including brass) as well as of higher-melting metal alloys;
FA Mod 1: die casting of large-volume components of copper and copper alloys (including brass) and aluminum;
FA Mod 2: forming of aluminum;
FC Mod 1: hot sheet forming (press hardening) with high wear resistance;
FC Mod 2: hot sheet forming (press hardening) with high wear resistance.

TABLE 1

| Material | Density [g/cm$^3$] | Specific heat [J/kgK] | Thermal conductivity [W/mK] | Coefficient of thermal conductivity [mm$^2$/s] | Modulus of elasticity [GPa] | Poisson's ratio |
|---|---|---|---|---|---|---|
| Conventional tool steels | | | | | | |
| Mat. No. 1.2343 | 7.750 | 462 | 24.621 | 6.876 | 221.086 | 0.28014 |
| Mat. No. 1.2344 | 7.665 | 466 | 24.332 | 6.811 | 224.555 | 0.28123 |
| Mat. No. 1.2365 | 7.828 | 471 | 31.358 | 8.505 | 217.124 | 0.28753 |
| Mat. No. 1.2367 | 7.806 | 460 | 29.786 | 8.295 | 220.107 | 0.28140 |
| Examples of hot-work steels according to the present invention | | | | | | |
| Specimen F1 | 7.949 | 444 | 56.633 | 16.0319 | 197418 | 0.2821 |
| Specimen F2 | 7.969 | 454 | 58.464 | 16.1594 | | |
| Specimen F3 | 7.965 | 449 | 55.550 | 15.5328 | | |
| Specimen F4 | 7.996 | 479 | 61.127 | 15.9364 | | |
| Specimen F5 | 7.916 | 440 | 64.231 | 18.4411 | 195.02 | 0.2844 |

TABLE 2

| MATERIAL | Hardness [HRc] | Yield strength [MPa] | Mechanical strength [MPa] | Elongate sure after fracture [%] | Elasticity [J] | Fracture resistance $K_{IC}$ [MPa m$^{-1/2}$] | Fatigue threshold $K_{TH}$ [MPa m$^{-1/2}$] |
|---|---|---|---|---|---|---|---|
| Mat. No. 1.2343 | 44-46 | 1170 | 1410 | 16 | 322 | 56 | 4.8 |
| Mat. No. 1.2344 | 44-46 | 1278 | 1478 | 14 | 364 | 49 | 4.7 |
| Mat. No. 1.2365 | 44-46 | 1440 | 1570 | 12 | 289 | 43 | |

TABLE 2-continued

| MATERIAL | Hardness [HRc] | Yield strength [MPa] | Mechanical strength [MPa] | Elongate sure after fracture [%] | Elasticity [J] | Fracture resistance $K_{IC}$ [MPa $m^{-1/2}$] | Fatigue threshold $K_{TH}$ [MPa $m^{-1/2}$] |
|---|---|---|---|---|---|---|---|
| Mat. No. 1.2367 | 44-46 | 1300 | 1490 | 13 | 215 | 41 | |
| Specimen F5 | 44-46 | 1340 | 1510 | 16 | >450 | 64 | 5.5 |
| Specimen F1 | 50-52 | 1560 | 1680 | 8 | 405 | 41 | 4.8 |

TABLE 3

| | Chemical composition | | | | | | | | |
|---|---|---|---|---|---|---|---|---|---|
| | % C | % Cr | % Mo | % W | % V | % Mn | % Si | other | λ [W/mK] |
| FC | 0.35 | 0.03 | 4 | 3.3 | 0.016 | 0.2 | 0.03 | | 66 |
| FC + 0.5Cr | 0.34 | 0.4 | 4 | 3.3 | 0.016 | 0.2 | 0.03 | | 48.8 |
| FC + 1Cr | 0.34 | 1.01 | 4 | 3.3 | 0.016 | 0.2 | 0.03 | | 44.8 |
| FC + 1.5Cr | 0.34 | 1.4 | 4 | 3.3 | 0.016 | 0.2 | 0.03 | | 42.6 |
| FC + 2Cr | 0.34 | 2.04 | 4 | 3.3 | 0.016 | 0.2 | 0.03 | | 41.5 |
| FC + 3C | 0.33 | 2.9 | 3.9 | 3.2 | 0.015 | 0.2 | 0.03 | | 37.6 |

TABLE 4

| | Chemical composition | | | | | | | | |
|---|---|---|---|---|---|---|---|---|---|
| | % C | % Cr | % Mo | % W | % V | % Mn | % Si | other | λ [W/mK] |
| FM | 0.33 | 0.02 | 4.3 | <0.1 | <0.01 | 0.24 | 0.22 | | 61 |
| FM + 0.5Cr | 0.33 | 0.6 | 4.3 | <0.1 | <0.01 | 0.24 | 0.22 | | 52 |
| FM + 1Cr | 0.33 | 0.8 | 4.3 | <0.1 | <0.01 | 0.24 | 0.22 | | 51 |
| FM + 1.5Cr | 0.33 | 1.64 | 4.3 | <0.1 | <0.01 | 0.24 | 0.22 | | 43 |
| FM + 2Cr | 0.33 | 2.07 | 4.3 | <0.1 | <0.01 | 0.24 | 0.22 | | 43 |
| FM + 3C | 0.32 | 3 | 4.2 | <0.1 | <0.01 | 0.24 | 0.22 | | 38 |

TABLE 5

| | Chemical composition | | | | | | | | |
|---|---|---|---|---|---|---|---|---|---|
| | % C | % Cr | % Mo | % W | % V | % Mn | % Si | other | λ [W/mK] |
| F | 0.32 | 0.02 | 3.8 | 3 | 0.009 | 0.2 | 0.04 | | 61 |

TABLE 6

| Alloy variant | Austenitizing temperature T [° C.] | Cooling medium | Hardness [HRc] | λ [W/mK) |
|---|---|---|---|---|
| F | 1040 | Air | 41 | 57 |
| F | 1060 | Air | 42 | 58 |

TABLE 6-continued

| Alloy variant | Austenitizing temperature T [° C.] | Cooling medium | Hardness [HRc] | λ [W/mK) |
|---|---|---|---|---|
| F | 1080 | Air | 40 | 61 |
| F | 1250 | Air | 42 | 56 |
| FC | 1080 | Oil | 47 | 52 |
| FC | 1080 | Air | 44 | 66 |
| FC | 1060 | Oil | 45 | 54 |
| FC | 1060 | Air | 44 | 63 |

TABLE 7

| | Chemical composition | | | | | | | | |
|---|---|---|---|---|---|---|---|---|---|
| | % C | % Cr | % Mo | % W | % V | % Mn | % Si | other | λ [W/mK] |
| FA | 0.29 | 0.02 | 3.1 | 2.1 | <0.01 | 0.27 | 0.1 | | 58 |
| FZ | 0.29 | 0.02 | 3.3 | 0.76 | 0.5 | 0.32 | 0.15 | Zr: 0.11; Co: 2.8 Hf: 0.14 | 46 |
| FW | 0.27 | 0.02 | 2.18 | 4.1 | <0.01 | 0.25 | 0.2 | | 56 |
| FV | 0.35 | 0.015 | 3.3 | 1.7 | 0.61 | 0.27 | 0.13 | | 51 |
| FAW | 0.28 | 0.02 | 2.58 | 3.0 | <0.01 | 0.26 | 0.16 | | 57 |

TABLE 7-continued

| | Chemical composition | | | | | | | |
|---|---|---|---|---|---|---|---|---|
| | % C | % Cr | % Mo | % W | % V | % Mn | % Si other | λ [W/mK] |
| FA Mod1 | 0.3 | 0.01 | 4.0 | 1.1 | <0.01 | 0.2 | 0.05 | 64 |
| FA Mod2 | 0.37 | 0.8 | 4.5 | 1.5 | <0.01 | 0.24 | 1.2 | 58 |
| FC Mod1 | 0.5 | <0.01 | 6.7 | 4 | <0.01 | 0.3 | 0.04 | 72 |
| F | 0.32 | 0.02 | 3.8 | 3 | 0.009 | 0.2 | 0.04 | 61 |
| FC Mod2 | 0.5 | 0.03 | 9 | 0.1 | <0.01 | 0.2 | 0.03 | 70 |

The invention claimed is:

1. A tool steel which is a hot-work steel comprising:

0.26 to 0.55% by weight C;

<2% by weight Cr;

0 to 10% by weight Mo;

0 to 15% by weight W;

wherein a content of W and Mo in total amounts to 1.8 to 15% by weight;

carbide-forming elements Ti, Zr, Hf, Nb, Ta with a content of from 0 to 3% by weight individually or in total;

0 to 4% by weight V;

0 to 6% by weight Co;

0 to 1.6% by weight Si;

0 to 2% by weight Mn;

0 to 2.99% by weight Ni;

0 to 1% by weight S; and remainder: iron and unavoidable impurities; and wherein the tool steel has a thermal conductivity which is set by metallurgically creating an internal structure of the tool steel in a defined manner such that carbidic constituents thereof have at least one of a defined electron and phonon density and a crystal structure thereof having a mean free length of a path for a phonon and electron flow that is determined by specifically created lattice defects, and wherein the hot-work steel has a thermal conductivity of more than 42 W/mK at room temperature.

2. A tool steel which is a hot-work steel comprising:

0.26 to 0.55% by weight C;

<2% by weight Cr;

0 to 10% by weight Mo;

0 to 15% by weight W;

wherein a content of W and Mo in total amounts to 1.8 to 15% by weight;

carbide-forming elements Ti, Zr, Hf, Nb, Ta with a content of from 0 to 3% by weight individually or in total;

0 to 4% by weight V;

0 to 6% by weight Co;

0 to 1.6% by weight Si;

0 to 2% by weight Mn;

0 to 2.99% by weight Ni;

0 to 1% by weight S; and remainder: iron and unavoidable impurities; and wherein the tool steel has a thermal conductivity which is set by metallurgically creating an internal structure of the tool steel in a defined manner such that carbidic constituents thereof have at least one of a defined electron and phonon density and a crystal structure thereof having a mean free length of a path for a phonon and electron flow that is determined by specifically created lattice defects, wherein the tool steel has a thermal conductivity of more than 42 W/mK at room temperature, and wherein a surface fraction and thermal conductivity of the carbidic constituents and a particular surface fraction and thermal conductivity of a matrix material contains the carbidic constituents.

3. A tool steel which is a hot-work steel comprising:

0.26 to 0.55% by weight C;

<2% by weight Cr;

0 to 10% by weight Mo;

0 to 15% by weight W;

wherein a content of W and Mo in total amounts to 1.8 to 15% by weight;

carbide-forming elements Ti, Zr, Hf, Nb, Ta with a content of from 0 to 3% by weight individually or in total;

0 to 4% by weight V;

0 to 6% by weight Co;

0 to 1.6% by weight Si;

0 to 2% by weight Mn;

0 to 2.99% by weight Ni;

0 to 1% by weight S; and remainder: iron and unavoidable impurities; and wherein the tool steel has a thermal conductivity which is set by metallurgically creating an internal structure of the tool steel in a defined manner such that carbidic constituents thereof have at least one of a defined electron and phonon density and a crystal structure thereof having a mean free length of a path for a phonon and electron flow that is determined by specifically created lattice defects, and wherein a surface fraction and thermal conductivity of the carbidic constituents and a particular surface fraction and thermal conductivity of a matrix material contains the carbidic constituents;

wherein a volume fraction and the thermal conductivity of the carbidic constituents and thermal conductivity of the matrix material contained the carbon constituents results in a thermal conductivity of the tool steel at room temperature being greater than 42 W/mk.

4. The tool steel according to claim 1, wherein the tool steel contains 2 to 15% by weight Mo and W in total.

5. The tool steel according to claim 1, wherein the tool steel contains less than 0.5% by weight Cr.

6. The tool steel according to claim 1, wherein the tool steel contains less than 0.2% by weight Cr.

7. The tool steel according to claim 1, wherein the tool steel contains less than 0.1% by weight Cr.

8. The tool steel according to claim 1, wherein the tool steel contains 0.5 to 10% by weight Mo.

9. The tool steel according to claim 1, wherein the tool steel contains at most 3% by weight Co.

10. The tool steel according to claim 1, wherein a molybdenum content of the tool steel is >1% by weight.

11. The tool steel according to claim 1, wherein a vanadium content of the tool steel is ≤2% by weight.

12. The tool steel according to claim 1, wherein the unavoidable impurities include at least one of elements Cu, P, Bi, Ca, As, Sn or Pb, with a content of at most 1% by weight individually or in total.

13. The tool steel according to claim 1, wherein the tool steel has a characteristic HC=xCeq−AC·[xMo/(3AMo)+xW/(3AW)+(xV−0.4)/AV] which lies between 0.03 and 0.165, wherein xCeq is a fraction by weight of carbon equivalent as a percentage, xMo is a fraction by weight of molybdenum as a percentage, xW is a fraction by weight of tungsten as a percentage, xV is a fraction by weight of vanadium as a percentage, AC is an atomic mass of carbon, AMo is an atomic mass of molybdenum, AW is an atomic mass of tungsten and AV is an atomic mass of vanadium.

14. The tool steel according to claim 2, wherein the tool steel contains less than 0.5% by weight Cr.

15. The tool steel according to claim 3, wherein the tool steel contains less than 0.5% by weight Cr.

16. The tool steel according to claim 2, wherein the tool steel contains 2 to 15% by weight Mo and W in total.

17. The tool steel according to claim 3, wherein the tool steel contains 2 to 15% by weight Mo and W in total.

18. The tool steel according to claim 2, wherein the tool steel contains less than 0.1% by weight Cr.

19. The tool steel according to claim 2, wherein the tool steel has a characteristic HC=xCeq−AC·[xMo/(3AMo)+xW/(3AW)+(xV−0.4)/AV] which lies between 0.03 and 0.165, wherein xCeq is a fraction by weight of carbon equivalent as a percentage, xMo is a fraction by weight of molybdenum as a percentage, xW is a fraction by weight of tungsten as a percentage, xV is a fraction by weight of vanadium as a percentage, AC is an atomic mass of carbon, AMo is an atomic mass of molybdenum, AW is an atomic mass of tungsten and AV is an atomic mass of vanadium.

20. The tool steel according to claim 3, wherein the tool steel has a characteristic HC=xCeq−AC·[xMo/(3AMo)+xW/(3AW)+(xV−0.4)/AV] which lies between 0.03 and 0.165, wherein xCeq is a fraction by weight of carbon equivalent as a percentage, xMo is a fraction by weight of molybdenum as a percentage, xW is a fraction by weight of tungsten as a percentage, xV is a fraction by weight of vanadium as a percentage, AC is an atomic mass of carbon, AMo is an atomic mass of molybdenum, AW is an atomic mass of tungsten and AV is an atomic mass of vanadium.

21. A tool steel which is a hot-work steel comprising:
0.26 to 0.55% by weight C;
<2% by weight Cr;
0 to 10% by weight Mo;
0 to 15% by weight W;
wherein a content of W and Mo in total amounts to 1.8 to 15% by weight;
carbide-forming elements Ti, Zr, Hf, Nb, Ta with a content of from 0 to 3% by weight individually or in total;
0 to 4% by weight V;
0 to 6% by weight Co;
0 to 1.6% by weight Si;
0 to 2% by weight Mn;
0 to 2.99% by weight Ni;
0 to 1% by weight S; and
remainder: iron and unavoidable impurities; and
wherein the tool steel has a thermal conductivity of more than 42 W/mK at room temperature.

22. The tool steel of claim 1 wherein the thermal conductivity is more than 48 W/mK at room temperature.

23. The tool steel of claim 1 wherein the thermal conductivity is more than 55 W/mK at room temperature.

24. The tool steel of claim 1 wherein the thermal conductivity is up to 60 W/mK at room temperature.

25. The tool steel of claim 1 consisting of:
0.26 to 0.55% by weight C;
<2% by weight Cr;
0 to 10% by weight Mo;
0 to 15% by weight W;
wherein a content of W and Mo in total amounts to 1.8 to 15% by weight;
carbide-forming elements Ti, Zr, Hf, Nb, Ta with a content of from 0 to 3% by weight individually or in total;
0 to 4% by weight V;
0 to 6% by weight Co;
0 to 1.6% by weight Si;
0 to 2% by weight Mn;
0 to 2.99% by weight Ni;
0 to 1% by weight S; and
remainder: iron and unavoidable impurities.

26. The tool steel of claim 1 in the physical form of an extrusion die, forging tool, die-casting die, or punch.

* * * * *